US010549145B2

(12) United States Patent
Liao et al.

(10) Patent No.: US 10,549,145 B2
(45) Date of Patent: Feb. 4, 2020

(54) STATIONARY EXERCISE APPARATUS WITH VARIABLE FOOT PATH

(71) Applicants: Hung-Mao Liao, Taichung (TW); Joe Chen, Taichung (TW)

(72) Inventors: Hung-Mao Liao, Taichung (TW); Joe Chen, Taichung (TW)

(73) Assignee: Johnson Health Tech Co., Ltd., Taichung (TW)

( * ) Notice: Subject to any disclaimer, the term of this patent is extended or adjusted under 35 U.S.C. 154(b) by 186 days.

(21) Appl. No.: 15/638,394

(22) Filed: Jun. 30, 2017

(65) Prior Publication Data

US 2019/0001183 A1 Jan. 3, 2019

(51) Int. Cl.

*A63B 22/00* (2006.01)
*A63B 22/06* (2006.01)
*A63B 23/035* (2006.01)

(52) U.S. Cl.

CPC ..... *A63B 22/0017* (2015.10); *A63B 22/0015* (2013.01); *A63B 22/0664* (2013.01); *A63B 23/035* (2013.01); *A63B 2022/0676* (2013.01)

(58) Field of Classification Search

CPC ..... A63B 22/0007–0017; A63B 2022/002; A63B 2022/0028–0043; A63B 22/0664; A63B 2022/067–0688; A63B 22/00–22/0069

See application file for complete search history.

(56) References Cited

U.S. PATENT DOCUMENTS 5,423,729 A * 6/1995 Eschenbach ..... A63B 22/001 482/51
6,687,019 B1 * 2/2004 Yang ..... G06K 15/02 358/1.15
6,689,019 B2 2/2004 Ohrt et al.
6,719,666 B1 * 4/2004 Lo ..... A63B 22/0015 482/52
6,994,656 B2 2/2006 Liao et al.
7,163,492 B1 * 1/2007 Sotiriades ..... A61H 1/0237 482/51
7,874,963 B2 * 1/2011 Grind ..... A63B 22/001 482/51
9,050,498 B2 * 6/2015 Lu ..... A63B 21/154
9,113,995 B2 * 8/2015 Scheller ..... A61F 9/00823
9,192,811 B1 * 11/2015 Miller ..... A63B 22/0664
9,248,071 B1 * 2/2016 Benda ..... A63B 69/0057
9,522,300 B1 * 12/2016 Miller ..... A63B 22/0664
9,597,540 B2 * 3/2017 Arnold ..... A63B 21/0052

(Continued)

*Primary Examiner* — Nyca T Nguyen

(57) ABSTRACT

An exercise apparatus includes a frame adapted to be rested on a floor surface, a crank mechanism that has two cranks mounted on the frame, two swing members pivotally mounted on the frame, two connecting assemblies, and a guiding device. Each of the two connecting assemblies has a plurality of connecting rods connecting the respective crank and the respective swing member. The two connecting assemblies define two pedal portions for supporting a user's feet, and up-and-down movement of the pedal portions causes rotation of the two cranks along a circular path. The guiding device is configured to connect the two swing members for guiding swing movement of the two swing members within a predetermined swing range. The predetermined swing range is adjustable so as to provide various exercise paths.

10 Claims, 10 Drawing Sheets

(56) References Cited

U.S. PATENT DOCUMENTS

| | | | | |
|---|---|---|---|---|
| 9,901,774 | B2 * | 2/2018 | Miller | A63B 21/156 |
| 2001/0036886 | A1 * | 11/2001 | Eschenbach | A63B 22/001 482/142 |
| 2003/0027690 | A1 * | 2/2003 | Miller | A63B 22/001 482/51 |
| 2004/0097340 | A1 * | 5/2004 | Liao | A63B 22/001 482/52 |
| 2008/0083177 | A1 * | 4/2008 | Tiberi | B29C 44/1233 52/233 |
| 2008/0261778 | A1 * | 10/2008 | Chuang | A63B 22/001 482/52 |
| 2010/0204017 | A1 * | 8/2010 | Uffelman | A63B 22/001 482/52 |
| 2013/0210585 | A1 * | 8/2013 | Arnold | A63B 21/0052 482/52 |
| 2014/0080675 | A1 * | 3/2014 | Anderson | A63B 71/0622 482/52 |
| 2016/0151660 | A1 * | 6/2016 | Ohrt | A63B 23/03591 482/52 |

* cited by examiner

STATIONARY EXERCISE APPARATUS WITH VARIABLE FOOT PATH

BACKGROUND

1. Field of the Invention

The present invention relates to an exercise apparatus. More particularly, the present invention relates to a stationary exercise apparatus with variable foot path.

2. Description of the Related Art

Indoor exercises are more and more popular nowadays, which are not affected by bad weather conditions unlike that of outdoor exercises. The conventional indoor exercise apparatuses for leg or lower body exercise include treadmill, exercise bike, elliptical exercise apparatus, stepper, etc. The aforementioned exercise apparatuses generally use movable pedals to guide foot path of a user except the treadmill. For example, the exercise bike is operable to guide the two pedals to move along a circular path, and the elliptical exercise apparatus is operable to guide the left and right pedals to move along a substantially elliptical path so as to provide an exercise apparatus for allowing people to simulate lower body exercise as walking or jagging.

However, the size of the foot path in the conventional exercise apparatus is unchangeable. U.S. Pat. Nos. 6,719,666 and 6,994,656 disclose an exercising device in which the foot movement may be varied to suit the requirement of different users. In addition, U.S. Pat. No. 6,689,019 discloses an exercise device capable of guiding the user's foot in a pseudo-elliptical stride path, while providing a dynamically variable stride length that allows the user to move with a natural stride length.

SUMMARY

The present invention is directed to a stationary exercise apparatus which is capable of being operated in various exercise modes by guiding the movement of user's feet.

According to one aspect of the present invention, an exercise apparatus comprises a frame adapted to be rested on a floor surface, a crank mechanism, two connecting assemblies, two swing members and a guiding device. The crank mechanism has a crankshaft rotatably mounted to the frame and a pair of cranks respectively mounted on two opposite ends of the crankshaft. The two connecting assemblies each defines a first pivot portion, a second pivot portion, a pedal portion and a plurality of connecting rods connecting the first pivot portion, the second pivot portion and the pedal portion. The first pivot portions of the two connecting assemblies are respectively pivotally connected to outer ends of the two cranks to move along a circular path about the crankshaft. The pedal portions of the two connecting assemblies are configured to support a user's feet, and up-and-down movement of the pedal portions causes the first pivot portions to be rotated along the circular path. The two swing members are pivotally mounted to the frame. Each swing member has an lower end pivotally connected to the second pivot portion of the corresponding connecting assembly, such that the second pivot portion is able to move forward and backward with respect to the frame. The guiding device is configured to connect the two swing members for guiding swing movement of the two swing members. The guiding device is able to provide a guiding force for limiting the swing movement of the two swing members within a predetermined swing range, and such predetermined swing range is adjustable. When the predetermined swing range is changed, an exercise path of the pedal portion is changed at the same time.

Preferably, the guiding device has a motor mounted on the frame and a linking mechanism connecting the motor and the two swing members, when a force of the user applied to the two swing members is insufficient to achieve the predetermined swing range, the motor is operable to provide an assisting force for assisting the swing movement of the two swing members to the predetermined swing range; and when the force of the user applied to the two swing members is excessive to exceed the predetermined swing range, the motor is operable to provide a resisting force for limiting the swing movement of the two swing members within the predetermined swing range.

Preferably, the motor is controlled by a motor controller to control the swing range of the two swing members, such that the exercise apparatus is able to provide three exercise modes. In a first exercise mode, the motor is controlled to hold the two swing members in a substantially parallel position, and the movement of the first pivot portions of the two connecting assemblies guides the up-and-down movement of the pedal portions. In a second exercise mode, the motor is controlled to limit the swing movement of the two swing members within a first swing range, and the movement of the first pivot portions of the two connecting assemblies guides the pedal portions to move along a substantially circular path. In a third exercise mode, the motor is controlled to limit the swing movement of the two swing members within a second swing range, and the movement of the first pivot portions of the two connecting assemblies guides the pedal portions to move along a substantially elliptical path.

Further benefits and advantages of the present invention will become apparent after a careful reading of the detailed description with appropriate reference to the accompanying drawings.

DETAIL DESCRIPTION

Figure 1:
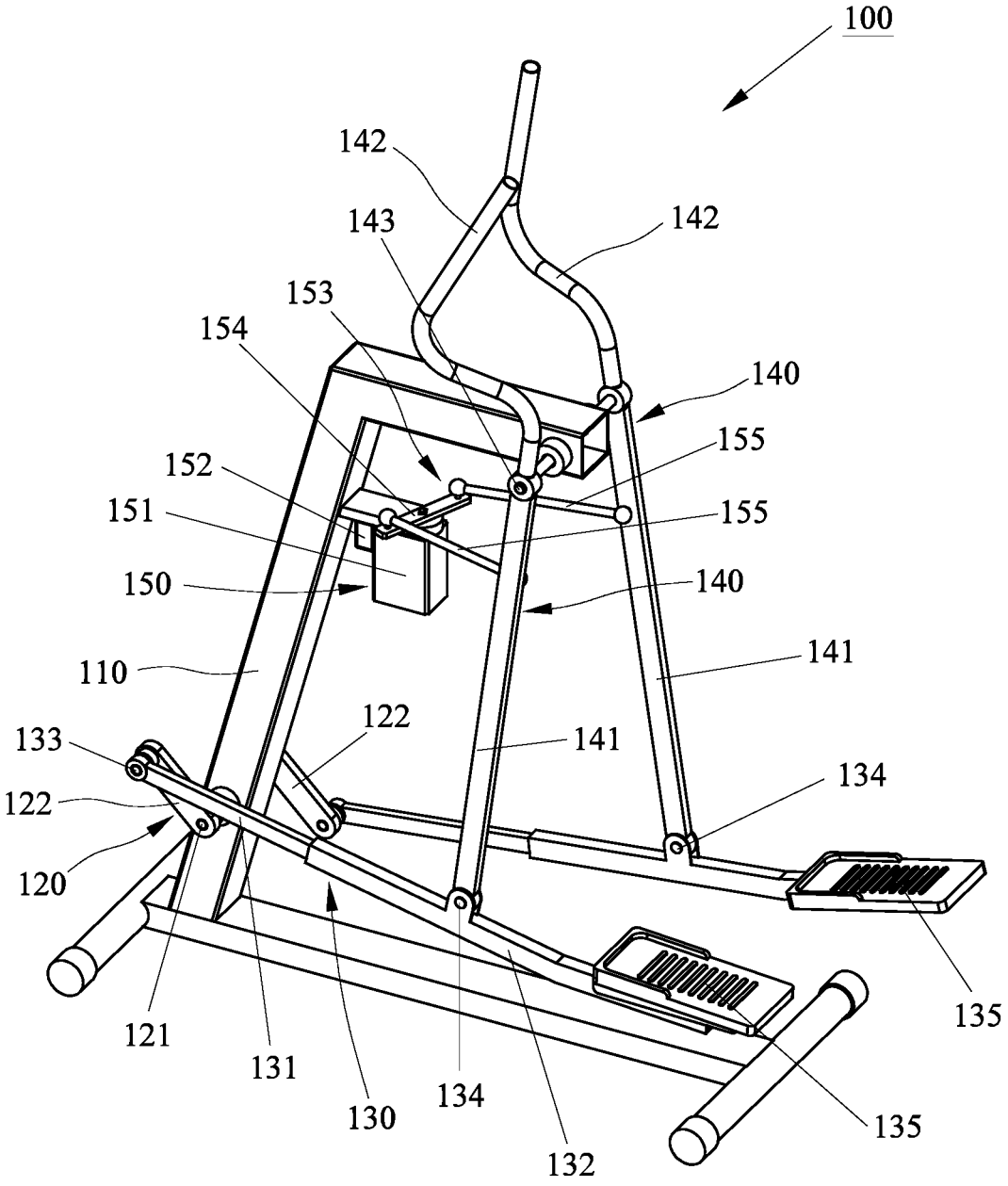
FIG. 1 is a perspective view of an exercise apparatus in accordance with a first preferred embodiment of the present invention.

Referring to FIG. 1 through FIG. 4, an exercise apparatus 100 in accordance with a first preferred embodiment of the present invention comprises a frame 110 adapted to be stably rested on a floor surface, a crank mechanism 120 mounted at a front portion of the frame 110, two connecting assemblies 130 disposed at left and right sides of the frame 110, and two swing members 140 pivotally mounted to the frame 110. The crank mechanism 120 has a crankshaft 121 transversely and pivotally mounted to the frame 110, and a pair of cranks 122 respectively fixed on two opposite ends of the crankshaft 121. The two cranks 122 are rotatable about the crankshaft 121, namely the outer ends of the two cranks 122 are rotatable in opposite directions to each other about the crankshaft 121 which is defined as a circle center, such that the two crank 122 are rotated along a circular path T1. The aforementioned crank mechanism 120 may be replaced by other means, for example, the two cranks 122 may be replaced by two discs having two symmetrical positions close to the periphery, which provides two opposite junctions being capable of moving along a closed circular path about the crankshaft 121 as a center, such mechanism is a conventional technique. In addition, the crank mechanism 120 is able to couple to a resistance device such as a flywheel, a magnetic or electromagnetic brake (not shown), so that the two cranks 122 must resist a predetermined resistance to rotate. However, the structure and operation of the resistance device are conventional techniques that are well known in the art, and the detailed description is not mentioned in the present invention.

The two swing members 140 are extended longitudinally and pivotally mounted to the frame 110 respectively. Each of the two connecting assemblies 130 is generally formed by a plurality of connecting rods, which defines a first pivot portion 133, a second pivot portion 134 and a pedal portion 135. The connecting rods connect the first pivot portion 133 and the second pivot portion 134. The first pivot portions 133 of the two connecting assemblies 130 are respectively pivotally connected to the outer ends of the two cranks 122 so as to be rotated along with the two cranks 122 in the circular path T1. The two swing members 140 are respectively pivotally mounted on the left and right side of the frame 110 at a third pivot portion 143. The third pivot portion 143 is substantially located at the top portion of the frame 110, namely located at a predetermined height. Each swing member 140 has a swing arm 141 and a handle 142 at lower and upper portion respectively, such that the handle 142 and the swing arm 141 can swing back and forth opposite to each other with respect to the third pivot portion 143. The swing arm 141 has an upper end pivotally connected to the frame 110 to form the third pivot portion 143 and a lower end pivotally connected to the second pivot portion 134 of the corresponding connecting assembly 130, so that the second pivot portion 134 is able to swing back and forth with respect to the third pivot portion 143. The handle 142 is extended upwardly from the upper end of the swing arm 141 namely the third pivot portion 143 for allowing a user to grasp. When the user exercises on the exercise apparatus 100, the user can grasp the handles 142 of the left and right swing members 140 with two hands to move forward and backward, and the swing arms 141 of the left and right swing members 140 are swung back and forth simultaneously. As shown in FIG. 1, the exercise apparatus 100 has two pedals respectively attached on the two connecting assemblies 130 to form the pedal portions 135 for supporting the user to the user's feet. When the user pedals up and down, the up-and-down movement of the pedal portions 135 drives the aforementioned connecting rods, which causes the first pivot portions 133 of the two connecting assemblies 130 to be rotated along the circular path T1.

Figure 2:
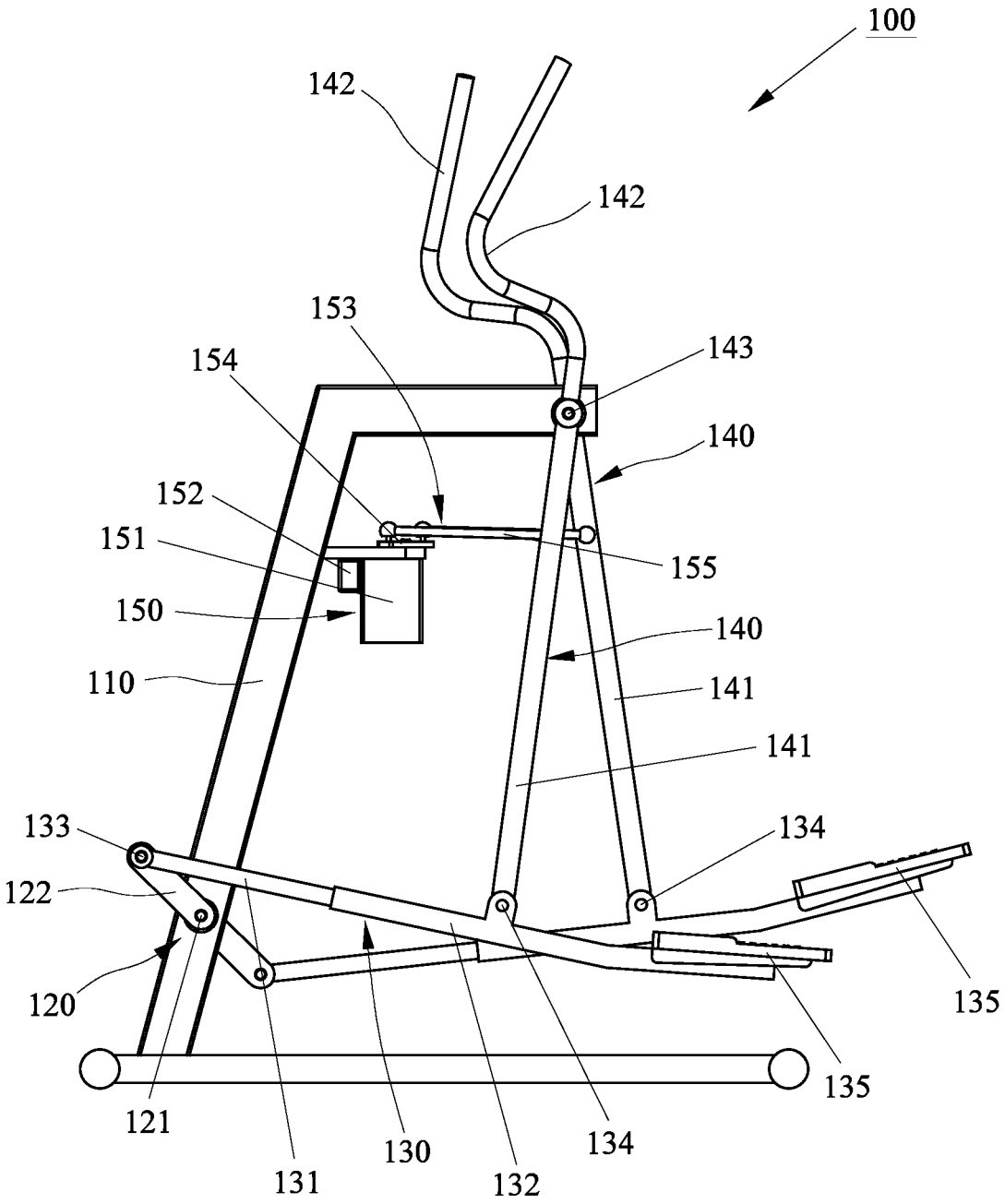
FIG. 2 is a side view of the exercise apparatus shown in FIG. 1.

As shown in FIG. 1, each of the connecting assemblies 130 is formed by a first rod 131 and a second rod 132. The first rod 131 and the second rod 132 are coupled with each other. In the first preferred embodiment, the first rod 131 and the second rod 132 are coaxially telescopically mounted with each other, so that the second rod 132 is movable relative to the first rod 131 in the longitudinal direction of the first rod 131. The first rod 131 has a front end pivotally connected to the corresponding crank 122 to form the first pivot portion 133. The lower end of the swing arm 141 of the respective swing member 140 is pivotally connected to the middle or front portion of the second rod 134 to form the second pivot portion 134, that is, the first pivot portion 133 and the second pivot portion 134 are respectively located at the first rod 131 and the second rod 132. The first rod 131 and the second rod 132 are arranged between the first pivot portion 133 and the second pivot portion 134. The pedal portion 135 is disposed at the rear end of the second rod 132, so that the pedal portion 135 is pivotable with respect to the second pivot portion 134. Under this arrangement, when the user's feet are in place upon the left and right pedal portions 135, and two hands respectively hold the left and right handles 142, and then drives the two swing arms 141 and the two connecting assemblies 130 with two feet and two hands, the user's feet will move along with the left and right pedal portions 135 in a closed path and the user's hands will move back and forth along with the left and right handles 142. As shown in FIG. 2, the second rod 132 is slidable relative to the first rod 131, so that the relative distance between the first pivot portion 133 and the second pivot portion 134 is variable, namely the maximum swing range (or swing angle) of the swing arm 141 is variable as well. Therefore, unlike a single rod connecting the crank and the swing arm, the distance between the first pivot portion and the second pivot portion is fixed, so that the exercise path of the pedal portion is also fixed. However, the exercise path of the exercise apparatus 100 of the present invention is changeable so as to provide various exercise modes for users.

Figure 3:
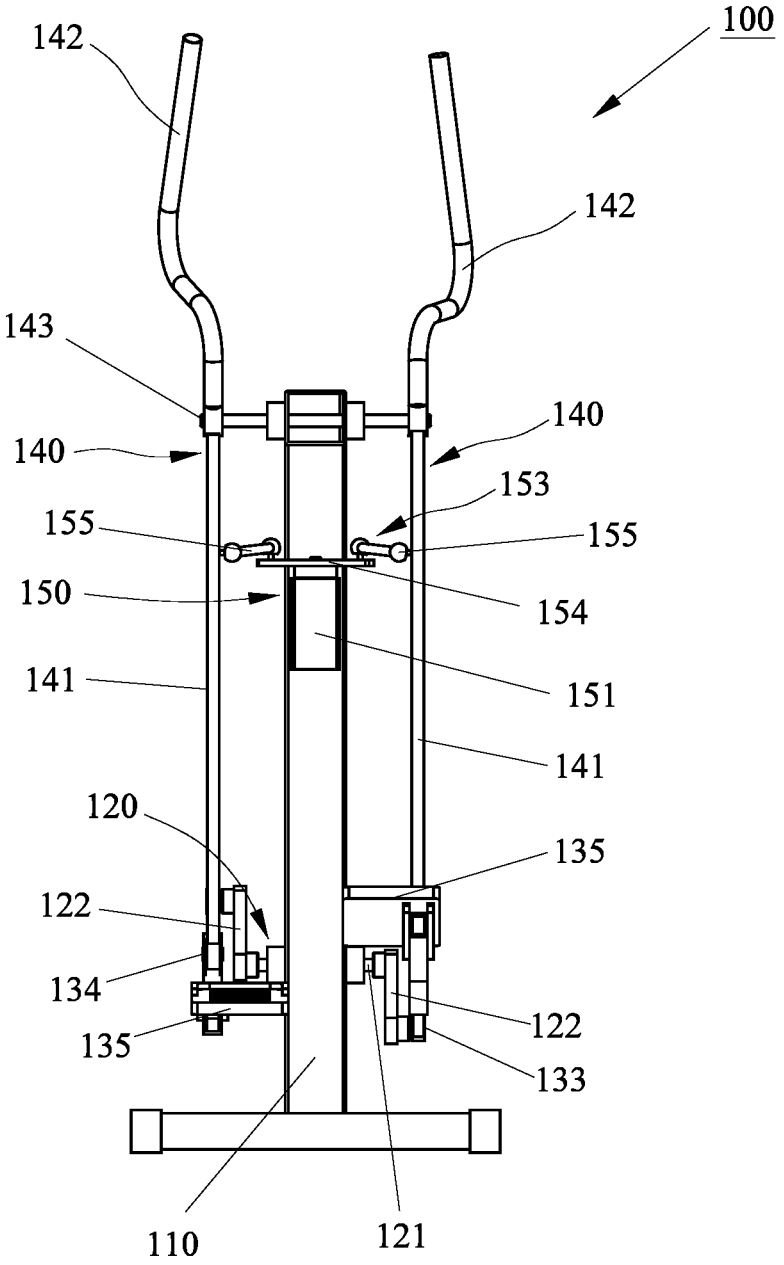
FIG. 3 is a rear elevational view of the exercise apparatus shown in FIG. 1.
Figure 4:
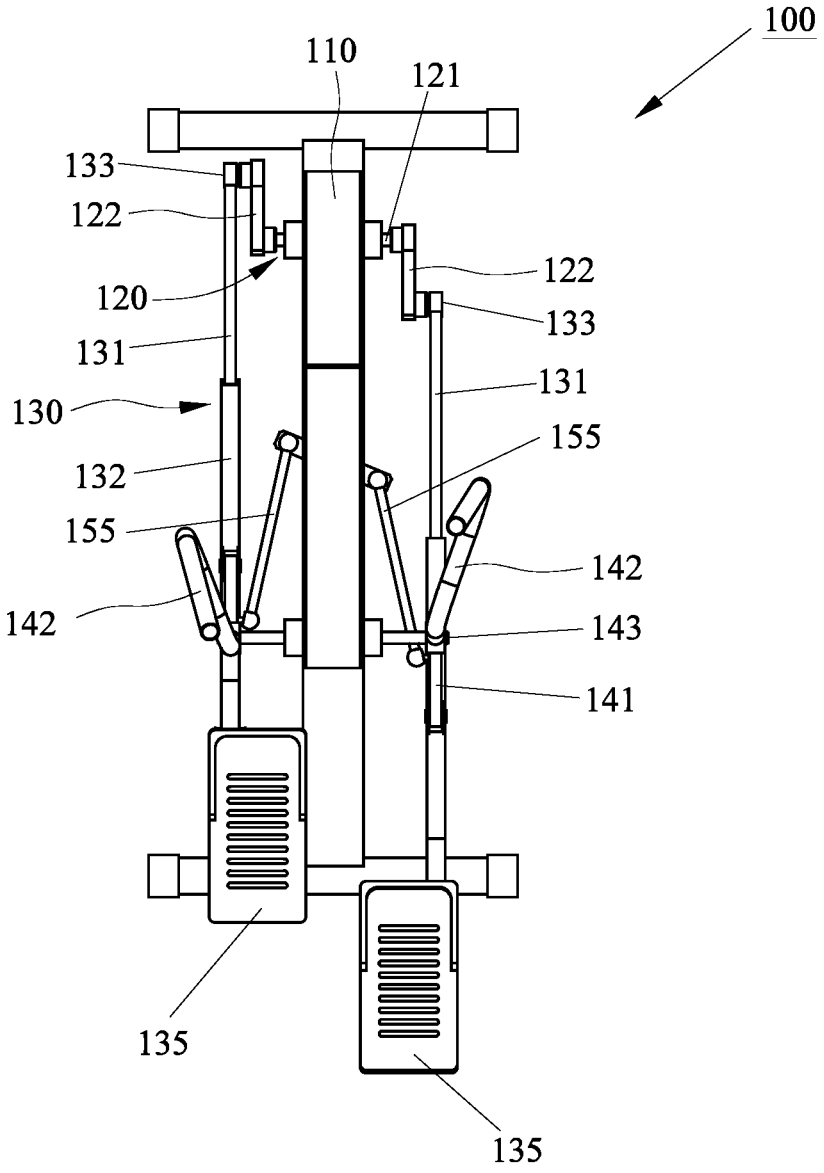
FIG. 4 is a top view of the exercise apparatus shown in FIG. 1.

Furthermore, the exercise apparatus 100 includes a guiding device 150 configured for guiding the swing movement of the left and right swing arms 141. The guiding device 150 is able to provide a guiding force for limiting the swing movement of the left and right swing arms 141 within a predetermined swing range, and such predetermined swing range is adjustable. When the predetermined range is changed, the exercise path of the pedal portions 135 is changed at the same time. As shown in FIG. 1 through FIG. 4, the guiding device 150 is mounted on the frame 110 and connects the left and right swing arms 141 for limiting the swing movement of the left and right swing arms 141. In the preferred embodiment, the guiding device 150 is a motor driving device, which includes a motor 151, a motor controller 152 and a linking mechanism 153. The motor 151 is fixed to a height position of the frame 110 corresponding to the upper half of the left and right swing arms 141, as shown in FIG. 3. The left and right swing arms 141 are substantially symmetrical to the motor 151. The linking mechanism 153 is configured to connect the motor 151 and the two swing arms 141, so that the two swing arms is able to swing back and forth alternatively. The linking mechanism 153 of the guiding device 150 has a link arm 154 and two link rods 155. The link arm 154 has a central portion fixed to a shaft of the motor 151, such that the link arm 154 is swingable by the shaft or the motor 151, namely the swing movement of the link arm 154 may be controlled by the motor 151. The left link rod 155 has two ends respectively connected to the left end of the link arm 154 and the inner side of the left swing arm 141. The right link rod 155 has two ends respectively connected to the right end of the link arm 154 and the inner side of the right swing arm 141. Under this arrangement, as shown in FIG. 4, the swing movement of the link arm 154 causes forward and backward movement of the left and right link rods 155 and further drives the left and right swing arms 141. The motor controller 152 is configured to control whether the motor is driven or not. In the preferred embodiment, each link rod 155 is pivotally connected to the corresponding swing arm 141 by means of, but not limited to, ball joint or other means.

In the preferred embodiment, the aforementioned motor 151 is regarded as an assisting device, that is, the two swing arms 141 are mainly driven by the user's feet and hands. Since the first rod 131 and the second rod 132 of the respective connecting assembly 130 are movably connected to each other, the swing range of the respective swing arm 141 is changed with the applied force of the user, but for the user who first used the exercise apparatus 100, the left and right swing arms may swing excessively due to the excessive force, and difficult to control the swing movement of two swing arms 141 within a predetermined swing range. Thus, by the assistance of the motor 151, it can provide a guiding force (or reverse resistance) for limiting the swing movement of the two swing members within the predetermined swing range so as to assist the user in maintaining motion under the predetermined swing range. Besides, the user is able to adjust the predetermined swing range to change the exercise path. In addition to provide the reverse resistance, the motor 151 capable of providing an assisting force for guiding the two swing arms 141. For example, when a force of the user applied to the two swing arms 141 is insufficient to achieve the predetermined swing range, the motor 151 is able to provide an assisting force for assisting the swing movement of the two swing arms 141 to the predetermined swing range.

Under this arrangement, when the user uses the exercise apparatus 100, the guiding device 150 can assist in guiding the user to exercise. In operation, the user has to pedal the left and right pedal portions 135 up and down, such up and down movement of the pedal portions 135 drives the two cranks 122 to produce a rotational inertia. After the rotational inertia of the two cranks 122 is produced, the left and right swing arms 141 are swung by the stride motion of the feet or the push-pull motion of the hands of the user, and the left and right pedal portions 135 will produce various exercise paths at the same time. However, if the user directly pushes and pulls the two swing members 140 without pedaling the two pedal portions 135 first, the two cranks 122 may not be rotated successfully to achieve the expected exercise path since the first rod 131 and the second rod 132 of the respective connecting assembly 130 are telescopically mounted with each other. In order to guide the user to exercise with correct movement, the motor 151 of the guiding device 150 is operable to lock the linking mechanism 153 temporarily and hold the left and right swing arms 141 at an initial position. When the use stands on the left and right pedal portions 135, it is able to guide the user to pedal the left and right pedal portions 135 up and down to drive the rotational movement of the two cranks 122. When detecting the two cranks 122 are rotated successfully, the left and right swing arms 141 are released. At this time, the user is able to drive the left and right swing arms 141 with movement of legs or hands, such that the left and right pedal portions 135 could be rotated in a closed path.

Figure 5:
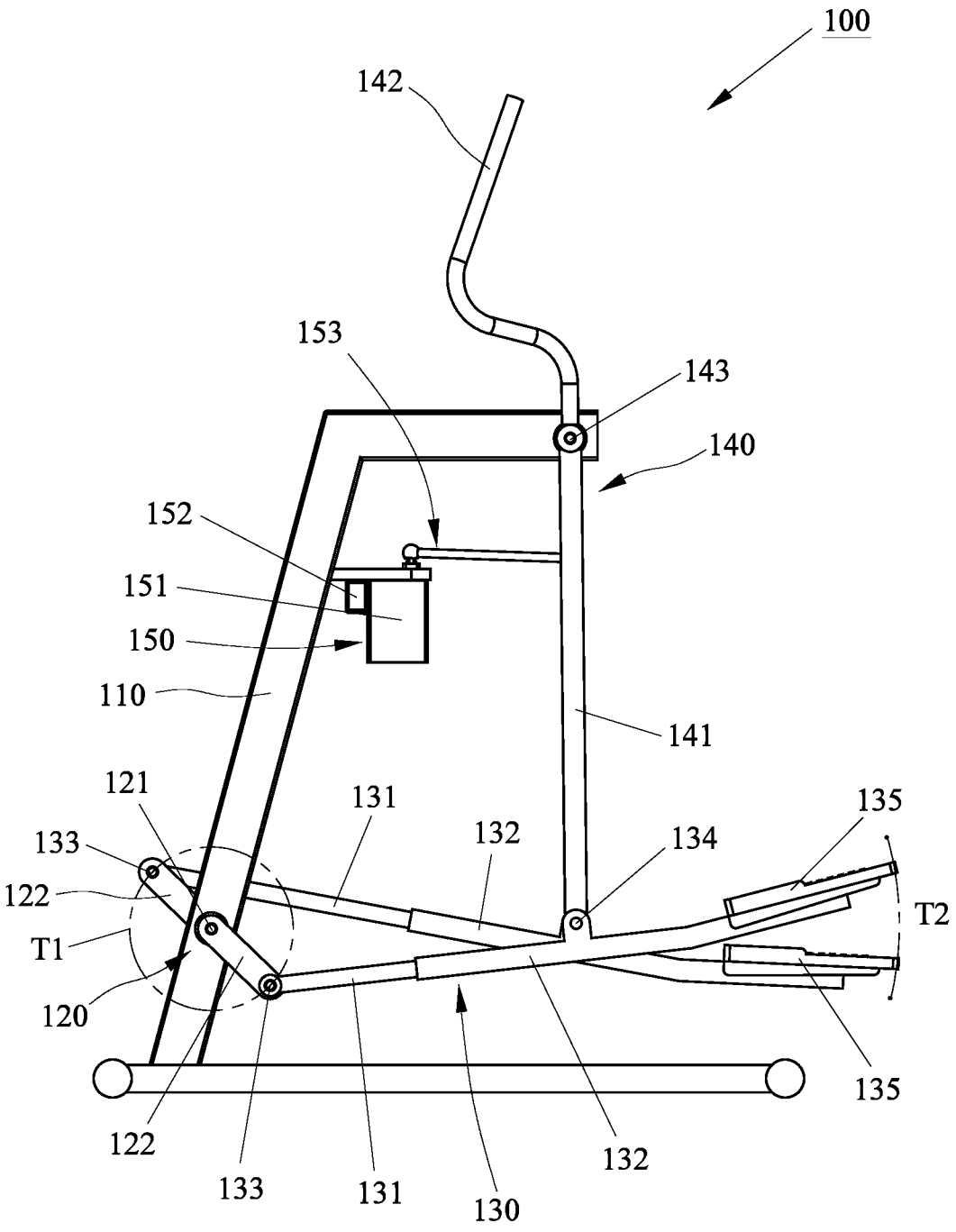
FIG. 5 illustrates that the exercise apparatus shown in FIG. 1 is operated in a first exercise mode.
Figure 6:
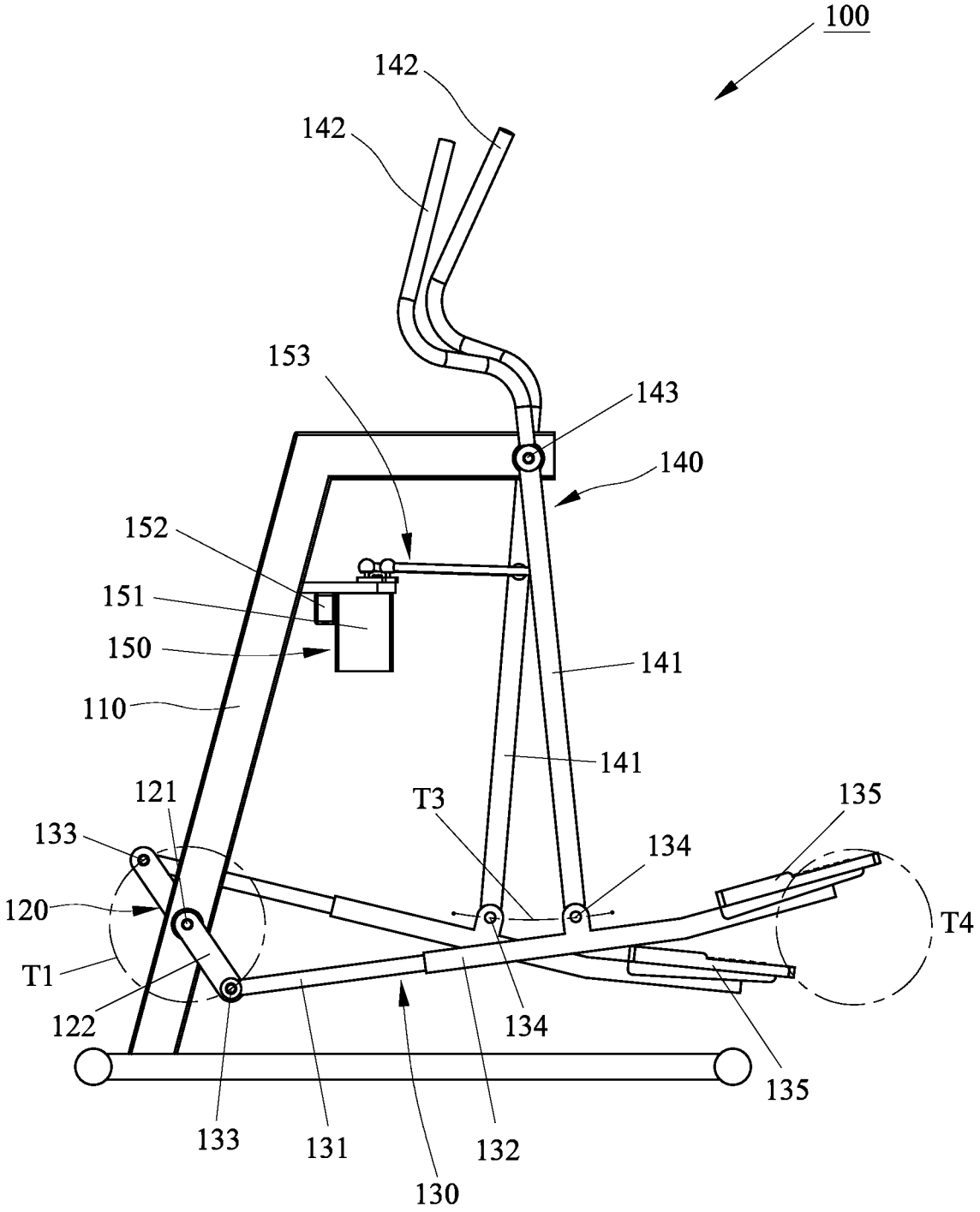
FIG. 6 illustrates that the exercise apparatus shown in FIG. 1 is operated in a second exercise mode.
Figure 7:
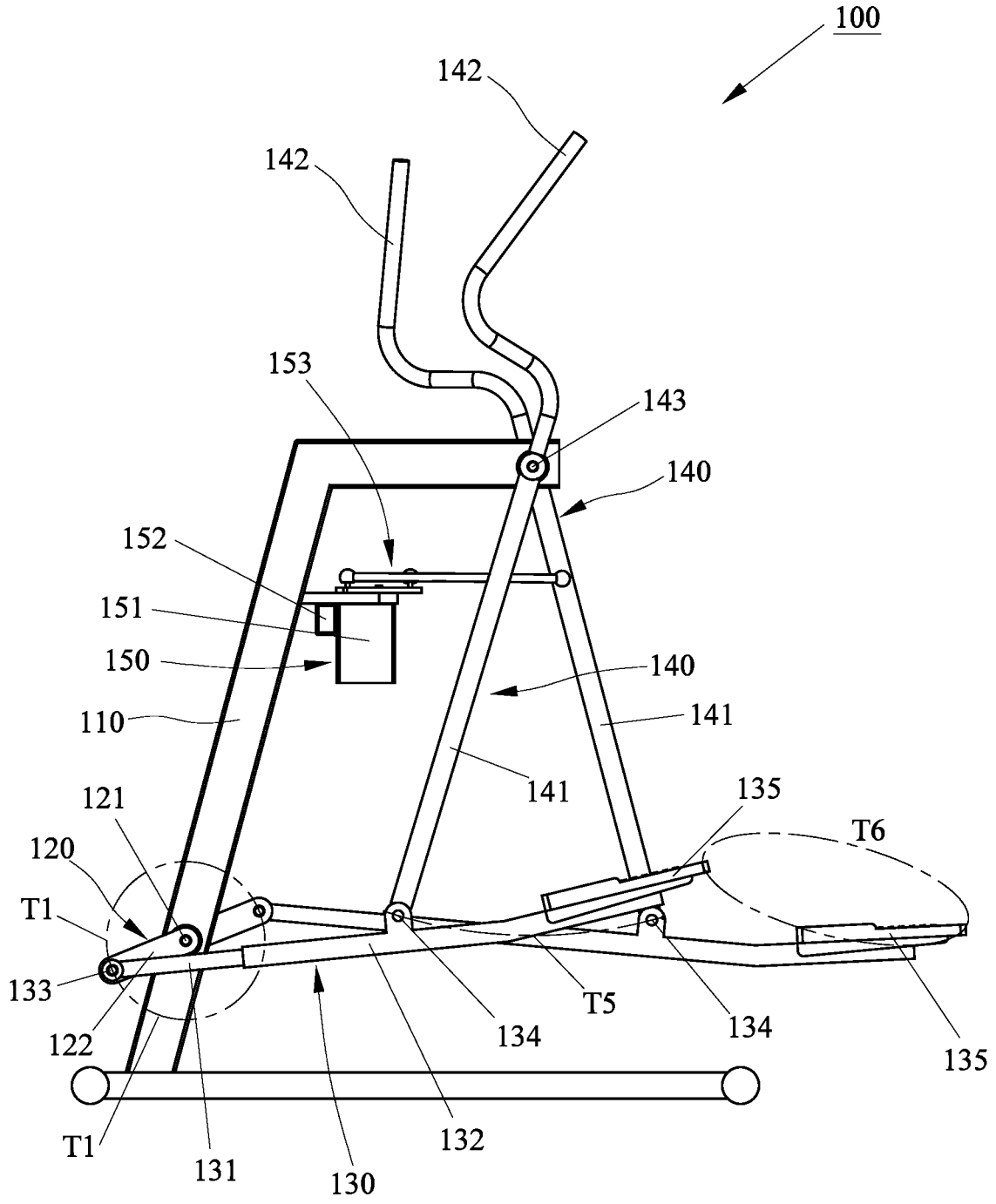
FIG. 7 illustrates that the exercise apparatus shown in FIG. 1 is operated in a third exercise mode.

Referring to FIG. 5 through FIG. 7, the motor 151 of the guiding device 150 could be controlled by the motor controller 152 to control the swing range of the left and right swing arms 141, such that the exercise apparatus 100 is able to provide various exercise modes or exercise paths. In the preferred embodiment of the present invention, the exercise apparatus 100 mainly provides the user with three exercise modes, namely first exercise mode (or stepping exercise mode), second exercise mode (or circle exercise mode), and third exercise mode (or elliptical exercise mode). The user can set and execute such exercise modes through a control interface (not shown). When the exercise apparatus 100 is operated in the first exercise mode, as shown in FIG. 5, the motor 151 is controlled to hold the two swing arms 141 in a substantially parallel position, so that the second pivot portions 134 of the two connecting assemblies 130 are fixed and opposite to each other. At this time, the user can pedal the left and right pedal portions 135 up and down to perform stepping exercise, such that the pedal portions 135 are moved along an arc-shaped path T2 with the center of the second pivot portion 134. The up-and-down movement of the pedal portions 135 drives the outer ends of the two cranks 122 namely the first pivot portions 133 to be rotated along the circular path T1, and the two connecting assemblies 130 are elongated and shortened correspondingly while the two cranks 122 are rotating. Thus, the exercise apparatus 100 is formed as a stepping exerciser for use. When the exercise apparatus 100 is operated in the second exercise mode, as shown in FIG. 6, the motor 151 is controlled to limit the swing movement of the two swig arms 141 within a first swing range, so that the second pivot portions 134 of the two connecting assemblies 130 are reciprocated along an arc shaped first swing path T3. The movement of the first pivot portions 133 of the two connecting assemblies 130 guides the pedal portions 135 to move along a first closed path T4 which is a substantially circular path, that is, the maximum distance of the first swing path T3 (or first swing range) is controlled by the motor 151 to be substantially equal to the distance between the uppermost and lowermost positions of the pedal portions 135 or to be substantially equal to a diameter of the circular path T1, such that the exercise path of the two pedal portions 135 is approximately circular. When the exercise apparatus 100 is operated in the third exercise mode, as shown in FIG. 7, the motor 151 is controlled to limit the swing movement of the two swig arms 141 within a second swing range, so that the second pivot portions 134 of the two connecting assemblies 130 are reciprocated along an arc shaped second swing path T5. The movement of the first pivot portions 133 of the two connecting assemblies 130 guides the pedal portions 135 to move along a second closed path T6 which is a substantially elliptical path, that is, the distance between the foremost and rearmost positions of the pedal portions 135 is greater than the distance between the uppermost and lowermost positions of the pedal portions 135 or the maximum distance of the second swing path T5 (or second swing range) is greater than the distance between the uppermost and lowermost positions of the pedal portions 135, such that the exercise path of the two pedal portions 135 is approximately elliptical. Thus, the second swing range is greater than the first swing range, namely the maximum distance of the second swing path T5 is greater than that of the first swing path T3. Of course, in the preferred embodiment, the user can manually adjust the swing range of the two swing arms 141 to create different exercise path.

Furthermore, the crank mechanism 120 has a rotational speed sensor (not shown) configured for detecting the rotational speed of the two cranks 122 as a basic for determining whether the motor controller 152 actuates the motor 151 or not. In the preferred embodiment, the motor 151 is actuated when the rotational speed sensor detects that the two cranks 122 start to rotate and the rotational speed of the two cranks 122 reaches a predetermined rotational speed. As mentioned before, the motor 151 generally holds the two swing arms 141 at the initial position first and releases the two swing arms 141 as the rotational speed sensor detects that the rotational speed of the two cranks 122 achieves the predetermined rotational speed, and then guiding the swing movement of the two swing arms 141 in order to guide the user to exercise with correct movement, namely the user must pedal the two pedal portions 135 to drive the rotation of the two cranks 122 first. When the two cranks 122 start rotating and produce a rotational inertia, the two swing arms 141 could be swung by the stride motion of the user's feet or the push-pull motion of the user's hands so as to perform the predetermined exercise mode (for example the elliptical exercise mode). Of course, if the user chooses the stepping exercise mode initially, the motor 151 will keep holding the two swing arms 141 in locked state, so that the user can directly grasp the handles 142 to perform stepping exercise. The aforementioned rotational speed sensor is well known in the bicycle art, which may be a magnetic sensor, infrared sensor or other sensing unit disposed on the crankshaft or crank, such detailed description is not mentioned in the present invention. Additionally, the motor 151 has a torque sensor (not shown) configured for detecting torque on the shaft of the motor 151 to determine the swing angle of the two swing arms 141. When the torque sensor detects that the swing force of the two swing arms 141 acting on the shaft of the motor is insufficient to achieve the predetermined swing range, the motor 151 is operable to provide an assisting force for assisting the swing movement of the two swing arms 141 to the predetermined swing range. When the torque sensor detects that the swing force of the two swing arms 141 acting on the shaft of the motor is excessive to exceed the predetermined swing range, the motor 151 is operable to provide a resisting force for limiting the swing movement of the two swing arms 141 to the predetermined swing range so as to prevent the two swing arms 141 from being swung excessively.

Figure 8:
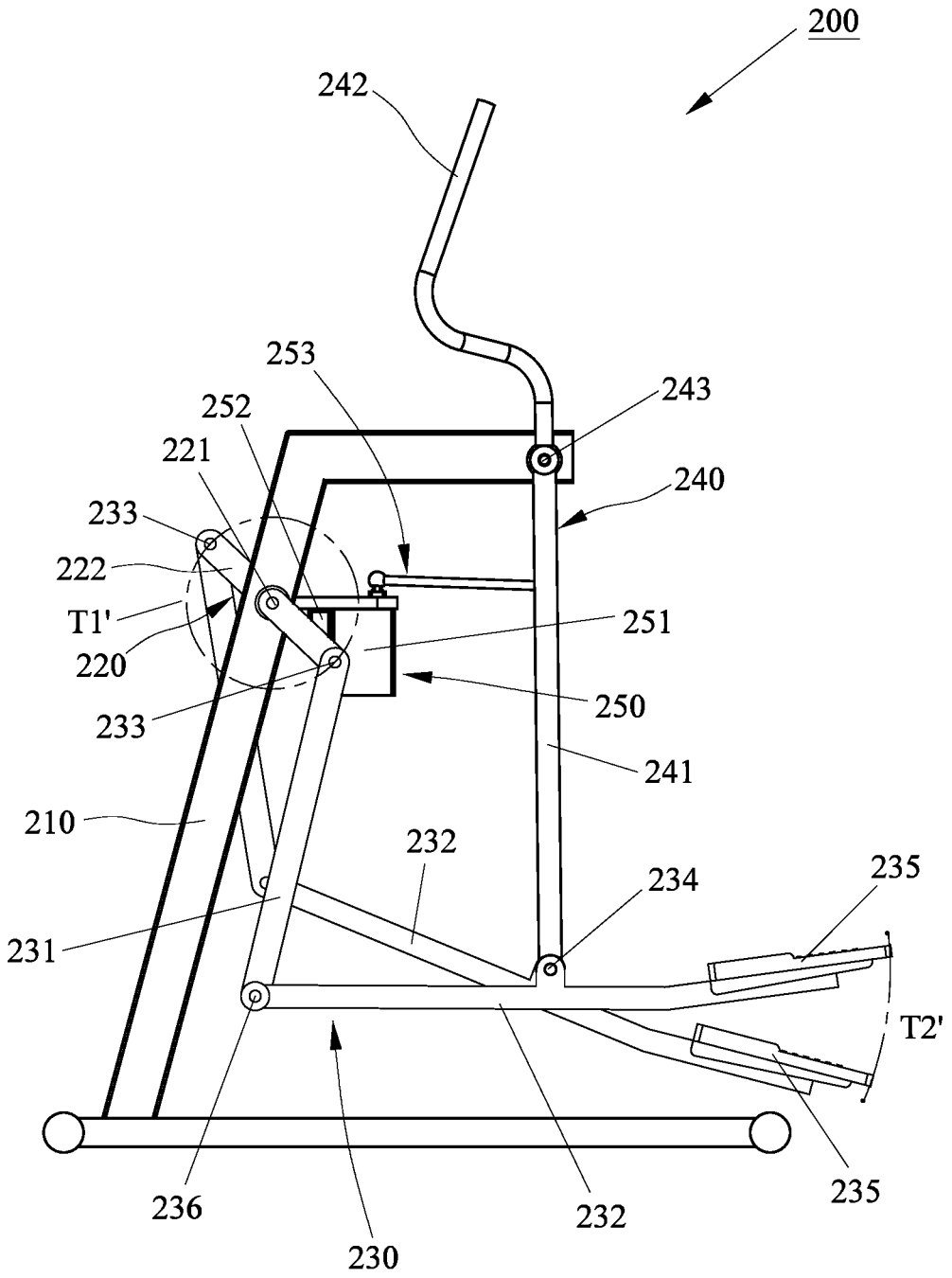
FIG. 8 is a side view of an exercise apparatus in accordance with a second preferred embodiment of the present invention for illustrating the exercise apparatus is operated in a first exercise mode.
Figure 9:
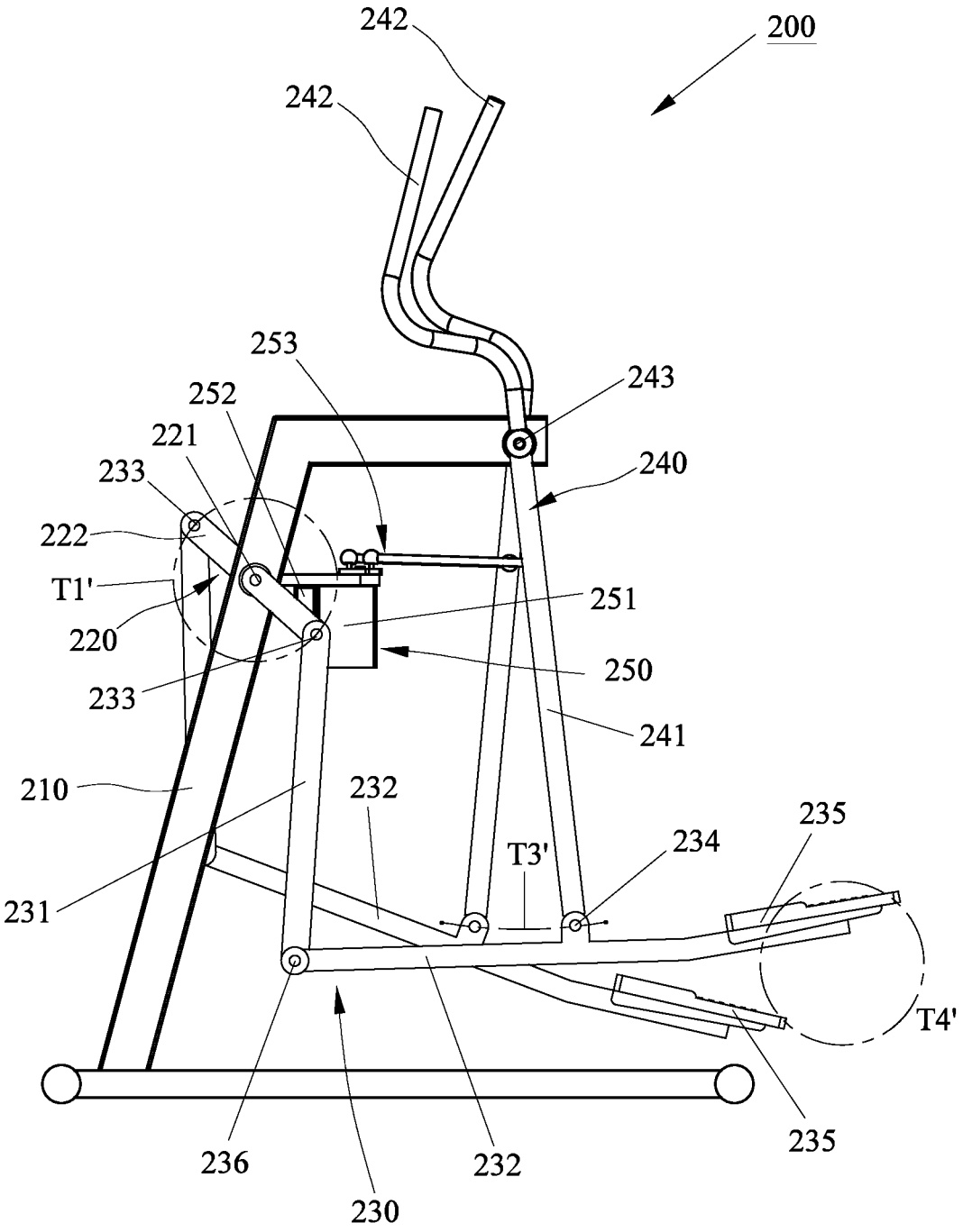
FIG. 9 illustrates that the exercise apparatus shown in FIG. 7 is operated in a second exercise mode.
Figure 10:
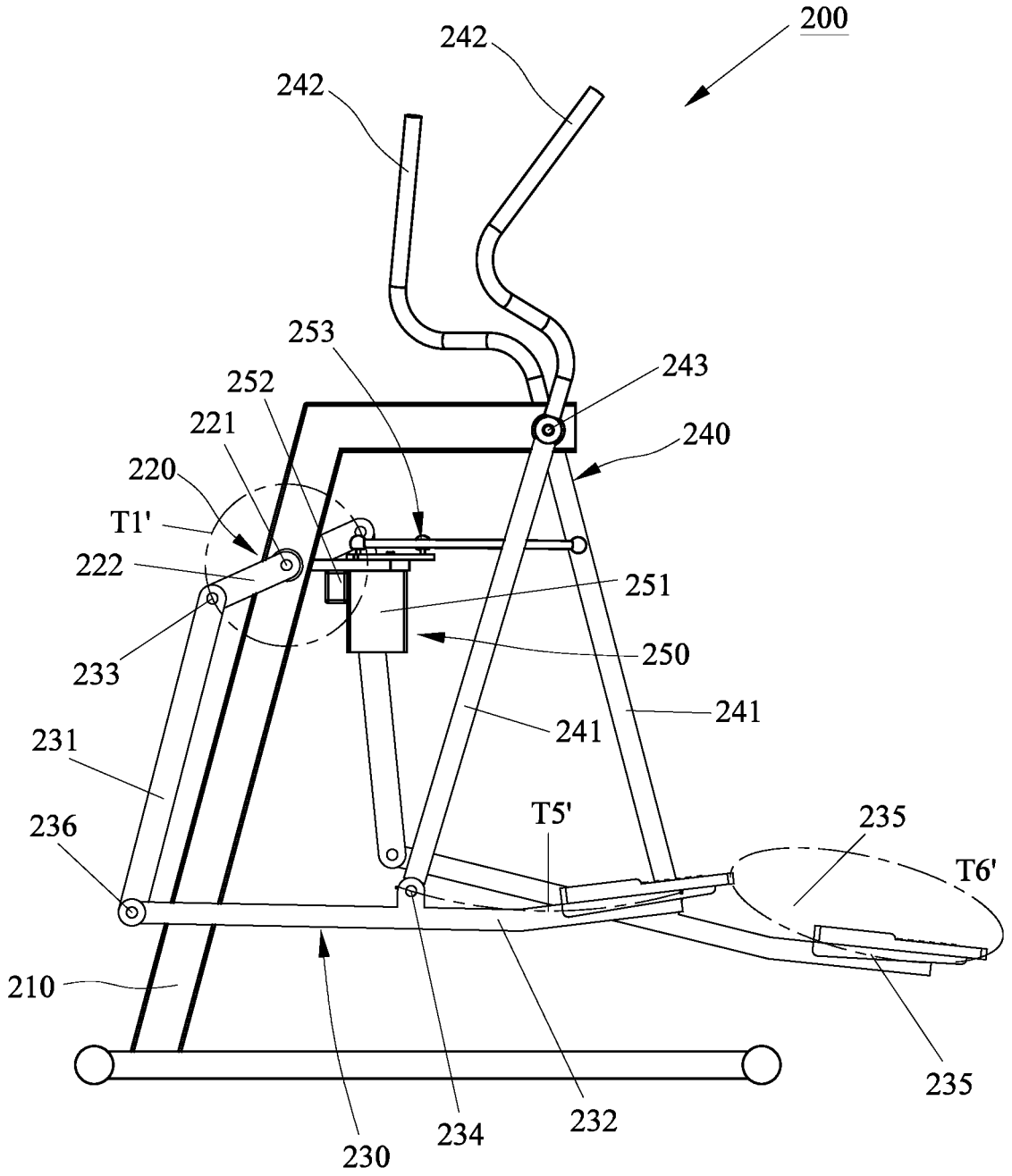
FIG. 10 illustrates that the exercise apparatus shown in FIG. 7 is operated in a third exercise mode.

It should be noted that the main object and function of the present invention is to provide a motor which connects the left and right swing arms for guiding the movement of the two swing arms to achieve an expected exercise path. In another embodiment of the present invention, the connecting assembly that links the crank mechanism and the swing arm may be different type. FIG. 8 through FIG. 10 show an exercise apparatus 200 in accordance with a second embodiment of the present invention. The second embodiment is similar to the first embodiment, except that the connecting assembly is different. The exercise apparatus 200 comprises a fame 210, a crank mechanism 220 mounted on a front portion of the frame 210, two connecting assemblies 230 respectively mounted at left and right sides of the frame 210, two swing members 240 pivotally mounted to the frame 210, and a guiding device 250 configured for guiding swing movement of the two swing members 240. Unlike the first embodiment, the crank mechanism 220 is disposed at a position near the top of the frame 210. The crank mechanism 220 has a crankshaft 221 transversely and pivotally mounted to the frame 210, and two cranks 222 respectively fixed on two opposite ends of the crankshaft 221, such that the outer ends of the two cranks 222 are rotated along a circular path T1'. Each of the two connecting assemblies 230 has first pivot portion 233 pivotally connected to the outer end of the corresponding crank 222 and a second pivot portion 234 pivotally connected to the lower end of the corresponding swing member 240, such that the first pivot portion 233 is located higher than the second pivot portion 234. The two swing members 240 are respectively pivotally mounted on the left and right side of the frame 210 at a third pivot portion 243. The third pivot portion 243 is substantially located at the top portion of the frame 210. Each swing member 240 has a swing arm 241 and a handle 242 at lower and upper portion respectively, such that the handle 242 and the swing arm 241 can swing back and forth opposite to each other with respect to the third pivot portion 243. The swing arm 241 has an upper end pivotally connected to the frame 210 to form the third pivot portion 243 and a lower end pivotally connected to the second pivot portion 234 of the corresponding connecting assembly 230, so that the second pivot portion 234 is able to swing back and forth with respect to the third pivot portion 243. The handle 242 is extended upwardly from the upper end of the swing arm 241 namely the third pivot portion 243 for allowing a user to grasp. When the user exercises on the exercise apparatus 200, the user can grasp the handles 242 of the left and right swing members 240 with two hands to move forward and backward, and the swing arms 241 of the left and right swing members 240 are swung back and forth simultaneously.

In the preferred embodiment, each of the connecting assemblies 230 is formed by a first rod 231 and a second rod 232. The first rod 231 and the second rod 232 are pivotally connected to each other. The first rod 231 is extended longitudinally, which has an upper end pivotally connected to the corresponding crank 222 to form the first pivot portion 233 and a lower end pivotally connected to the front end of the second rod 232 to form a fourth pivot portion 236, such that the fourth pivot portion 236 is pivotable with respect to the first pivot portion 233. The second rod 232 forms a pedal portion 235 on the rear end thereof. The second rod 232 is pivotally connected to the corresponding swing arm 241 at the second pivot portion 234. The second pivot portion 234 is located between the fourth pivot portion 236 and the pedal portion 235. When the user pedals up and down, the up-and-down movement of the pedal portions 235 drives the first and second rods 231, 232, causing the first pivot portions 233 of the two connecting assemblies 230 to be rotated along the circular path T1'. Therefore, the pedal portions 235 can be moved along with the two swing arms 241 to create various exercise paths.

The exercise apparatus 200 includes a guiding device 250 configured for guiding the swing movement of the left and right swing arms 241 within a predetermined swing range, and such predetermined swing range is adjustable. When the predetermined range is changed, the exercise path of the pedal portions 235 is changed at the same time. The guiding device 250 is mounted on the frame 210 and connects the left and right swing arms 241 for limiting the swing movement of the left and right swing arms 241. In the preferred embodiment, the guiding device 250 includes a motor 251, a motor controller 252 configured to control the operation of the motor 251 and a linking mechanism 253 connecting the motor 251 and the two swing arms 241, so that the left and right swing arms 241 can be swung relative to each other. The detailed description of the linking mechanism 253 is described in the first embodiment.

As shown in FIG. 8 through FIG. 10, by means of the guiding device 250, the exercise apparatus 200 is able to provide three exercise modes which can be controlled through a control interface. As shown in FIG. 8, when the exercise apparatus 100 is operated in the first exercise mode (or stepping exercise mode), the motor 251 is controlled to hold the two swing arms 241 in a substantially parallel position, so that the second pivot portions 234 of the two connecting assemblies 230 are fixed and opposite to each other. At this time, the user can pedal the left and right pedal portions 235 up and down to perform stepping exercise, such that the pedal portions 235 are moved along an arc-shaped path T2' and drives the first pivot portions 233 to rotate along the circular path T1'. Thus, the exercise apparatus 200 is formed as a stepping exerciser for use. As shown in FIG. 9, when the exercise apparatus 200 is operated in the second exercise mode (or circle exercise mode), the motor 251 is controlled to limit the swing movement of the two swig arms 241 within a first swing range, so that the second pivot portions 234 of the two connecting assemblies 230 are reciprocated along an arc shaped first swing path T3'. The movement of the first pivot portions 233 of the two connecting assemblies 230 guides the pedal portions 235 to move along a first closed path T4' which is a substantially circular path. As shown in FIG. 10, when the exercise apparatus 200 is operated in the third exercise mode (or elliptical exercise mode), the motor 251 is controlled to limit the swing movement of the two swig arms 241 within a second swing range, so that the second pivot portions 234 of the two connecting assemblies 230 are reciprocated along an arc shaped second swing path T5'. The movement of the first pivot portions 233 of the two connecting assemblies 230 guides the pedal portions 235 to move along a second closed path T6' which is a substantially elliptical path, that is, the distance between the foremost and rearmost positions of the pedal portions 135 is greater than the distance between the uppermost and lowermost positions of the pedal portions 235 or the maximum distance of the second swing path T5 (or second swing range) is greater than the distance between the uppermost and lowermost positions of the pedal portions 235, such that the exercise path of the two pedal portions 235 is approximately elliptical. Thus, the second swing range is greater than the first swing range, namely the maximum distance of the second swing path T5' is greater than that of the first swing path T3'. Of course, in the preferred embodiment, the user can manually adjust the swing range of the two swing arms 241 to create different exercise path.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An exercise apparatus, comprising:

a frame adapted to be rested on a floor surface;

a crank mechanism having a crankshaft rotatably mounted to the frame and a pair of cranks respectively mounted on two opposite ends of the crankshaft;

two connecting assemblies, each defining a first pivot portion, a second pivot portion, a pedal portion and a plurality of connecting rods connecting the first pivot portion, the second pivot portion and the pedal portion, the first pivot portions of the two connecting assemblies respectively pivotally connected to outer ends of the two cranks to move along a circular path about the crankshaft, the pedal portions of the two connecting assemblies configured to support a user's feet, and up-and-down movement of the pedal portions causing the first pivot portions to be rotated along the circular path;

two swing members pivotally mounted to the frame, each of the two swing members having a lower end pivotally connected to the second pivot portion of the corresponding connecting assembly, such that the second pivot portion is able to move forward and backward with respect to the frame; and a guiding device having a motor mounted on the frame and coupled to the two swing members for guiding swing movement of the two swing members within a predetermined range, when a force of the user applied to the two swing members is insufficient to achieve the predetermined swing range, the motor is operable to provide an assisting force for assisting the movement of the two swing members to the predetermined swing range;

wherein, the predetermined swing range is adjustable, when the predetermined swing range is changed, an exercise path of the pedal portion is changed at the same time.

2. The exercise apparatus as claimed in claim 1, wherein the exercise apparatus provides three exercise modes; in a first exercise mode, the motor is controlled to hold the two swing members in a substantially parallel position, and the movement of the first pivot portions of the two connecting assemblies guides the up-and-down movement of the pedal portions; in a second exercise mode, the motor is controlled to limit the movement of the two swing members within a first swing range, and the movement of the first pivot portions of the two connecting assemblies guides the pedal portions to move along a substantially circular path; in a third exercise mode, the motor is controlled to limit the movement of the two swing members within a second swing range, and the movement of the first pivot portions of the two connecting assemblies guides the pedal portions to move along a substantially elliptical path; wherein the second swing range is greater than the first swing range.

3. The exercise apparatus as claimed in claim 2, wherein a maximum distance of the first swing range is substantially equal to a diameter of the circular path in which the first pivot portion is rotated; and a maximum distance of the second swing range is greater than the diameter of the circular path in which the first pivot portion is rotated.

4. The exercise apparatus as claimed in claim 1, wherein the crank mechanism has a rotational speed sensor configured for detecting a rotational speed of the two cranks, when the rotational speed sensor detects that the rotational speed of the two cranks achieves a predetermined rotational speed, the motor is actuated.

5. The exercise apparatus as claimed in claim 1, wherein the guiding device further has a linking mechanism connecting the motor and the two swing members, the linking mechanism of the guiding device having a link arm and two link rods, the motor having a shaft fixed to the link arm so that the link arm is swingable by the shaft of the motor, the two link rods respectively connecting two ends of the link arm to the two swing members so that the two swing members are interconnected with each other and moved in opposite directions relative to one another.

6. The exercise apparatus as claimed in claim 5, wherein the motor has a torque sensor configured for detecting torque on the shaft of the motor to determine a swing angle of the two swing members, when the torque sensor detects that a swing force of the two swing members acting on the shaft of the motor is insufficient to achieve the predetermined swing range, the motor is operable to provide an assisting force for assisting the swing movement of the two swing members to the predetermined swing range; and when the torque sensor detects that the swing force of the two swing members acting on the shaft of the motor is excessive to exceed the predetermined swing range, the motor is operable to provide a resisting force for limiting the swing movement of the two swing members within the predetermined swing range.

7. The exercise apparatus as claimed in claim 1, wherein the connecting rods of each connecting assembly include a first rod and a second rod pivotally connected with each other, the first rod having one end pivotally connected to the corresponding crank to form the first pivot portion and the other end pivotally connected to one end of the second rod, the second rod pivotally connected to the corresponding swing member at the second pivot portion and the pedal portion defined on the other end of the second rod, such that second rod is pivotable relative to the first rod.

8. The exercise apparatus as claimed in claim 1, wherein when the force of the user applied to the two swing members is excessive to exceed the predetermined swing range, the motor is operable to provide a resisting force for limiting the movement of the two swing members within the predetermined swing range.

9. The exercise apparatus as claimed in claim 1, wherein the connecting rods of each connecting assembly include a first rod and a second rod telescopically mounted with each other, the first rod having a front end pivotally connected to the corresponding crank to form the first pivot portion, the second rod pivotally connected to the corresponding swing member at the second pivot portion and the pedal portion defined on the second rod opposite to the first rod, such that the second rod is movable relative to a longitudinal direction of the first rod.

10. The exercise apparatus as claimed in claim 7, wherein a position of the first pivot portion of each connecting assembly is located higher than a position of the second pivot portion.

* * * * *